US007186212B1

(12) United States Patent
McMullen

(10) Patent No.: US 7,186,212 B1
(45) Date of Patent: Mar. 6, 2007

(54) FULL SIZE FULLY ARTICULATED DOLL WITH SELECTIVELY DISPLAYED ALTERATIVE FACES

(76) Inventor: Matthew McMullen, 1729 Victoria Way, San Marcos, CA (US) 92069

( * ) Notice: Subject to any disclaimer, the term of this patent is extended or adjusted under 35 U.S.C. 154(b) by 386 days.

(21) Appl. No.: 10/684,485

(22) Filed: Oct. 15, 2003

Related U.S. Application Data

(60) Provisional application No. 60/470,203, filed on May 14, 2003.

(51) Int. Cl.
*A61F 5/00* (2006.01)

(52) U.S. Cl. ..... 600/38

(58) Field of Classification Search ..... 600/38–41; 434/267, 268, 262, 272–275; 446/373, 370, 446/385; 128/897, 898
See application file for complete search history.

(56) References Cited

U.S. PATENT DOCUMENTS 4,070,790 A * 1/1978 Strongin et al. ..... 446/394
4,805,328 A * 2/1989 Mirahem ..... 40/457
5,466,235 A * 11/1995 Shubin, Sr. ..... 600/38
6,109,921 A * 8/2000 Yau ..... 434/100
6,612,045 B2 * 9/2003 Kruskamp ..... 33/526
6,758,717 B1 * 7/2004 Park et al. ..... 446/391
2002/0107431 A1 * 8/2002 More ..... 600/38

OTHER PUBLICATIONS

Realdolls, Apr. 9, 2002, 29 pages, printed from www.realdoll.com.*

* cited by examiner

*Primary Examiner*—Samuel G. Gilbert
(74) *Attorney, Agent, or Firm*—Peter Gibson

(57) ABSTRACT

A full size fully articulated doll possessing visual and postural verisimilitude with that of an adult human female is provided selectively displayed alternative faces with exchange of faces masks or heads. Articulation is provided by an internal skeleton having movable joints between rigid members. A flexible resilient material inclusive of silicone rubber is used for simulated skin inclusive of the faces. A rigid moldable material inclusive of epoxy is used for a simulated skull possessing a movable jaw that can be displaced mechanically. An audio device can be added to provide aural verisimilitude in conjunction with the movable jaw and artificial eyeballs can also be displaced mechanically. A moderately soft resilient material inclusive of polyurethane foam is used for simulated flesh. Alternatively selected faces enable variation of appearance inclusive of both expression and genotype.

46 Claims, 4 Drawing Sheets

FULL SIZE FULLY ARTICULATED DOLL WITH SELECTIVELY DISPLAYED ALTERATIVE FACES

This application claims benefit of the earlier filing date of Provisional Application No. 60/470,203 filed May 14, 2003 in the name of the present inventor.

BACKGROUND OF THE INVENTION

1. Field of the Invention

The present invention relates:

(a) generally to figure toy amusement devices with selectively displayed alternative faces;

(b) particularly to figure toy amusement devices having selectively displayed alternative faces and enclosed reinforcing or skeletal portions; and (c) most specifically to figure toy amusement devices having selectively displayed alternative faces and enclosed reinforcing or skeletal portions including pivoted joints.

2. General Background

Various approaches to achieving anatomical verisimilitude in full size human figure Dolls or mannequins are known as reflected by the categorization recited above in the 'field of the invention' taken directly from the Classification Manual of the U.S. Patent Office. And, as further reflected by said categorization, these approaches are typically mutually exclusive. This is considered to reflect, most fundamentally, the practicalities of the matter in that full size human figures are made for different purposes and the approach or aspect desired for a particular purpose is typically focused upon to the exclusion of other aspects simply because it would be too expensive to provide more than the aspect required.

Broadly speaking it is considered that appearance is generally one matter and variable posture another. The truth to this is perhaps best or most easily set forth with reference to the earliest and most famous, i.e. seminal, myth regarding the attempt to create a full size human figure having a fully human verisimilitude, Pygmalion, "A king of Cyprus who carved and then fell in love with a statue of a woman, which Aphrodite brought to life as Galatea" (*American Heritage Dictionary,* 2$^{nd}$ Edition, Houghton Mifflin Co., Boston, 1985).

Pygmalion is, of course, a myth and that is part of the point to be appreciated: it is not possible to create a person but the desire to do so is very strong, particularly on the part of males, in the creation of female forms, with the physical techniques they have mastered. Although both a woman and a man are necessary to create another human it is women, obviously, who endure pregnancy and actually give birth after nourishing the fetus for nine months. Every person alive is hence the flesh and bone of their mother, necessarily a woman, and all a man can do to create a person is to persuade a woman to accept his seed; or rape one. This may seem a crude if not crazy digression but is considered wholly germane to the present invention for reasons explained presently.

One of the purposes of creating an anatomical verisimilitude of a human being, particularly a woman, and for making that 'doll', for lack of a better word, as 'life-like' as possible is for male adult amusement including sexual release. This is appreciated to be a controversial topic and subject matter particularly for patents. It is recognized that many people find the very idea of a 'sex doll' repugnant. But it is considered that, prudery aside, sex dolls can actually only provide a very valuable contribution to society as an avenue for the release of frustrated sexual urges that otherwise readily lead to the contemplation of if not the commission of rape and or other violence.

The foundation of this argument lies in the logical application of Darwinian principles applied to the human species and the recognition that the male sex hormone, testosterone, induces a sexual urge that is closely related to, if not wholly responsible for, male aggression. The availability of plausible substitutes to humans in the release of frustrated sexual urges is hence seen to provide an alternative to: (a) rape, (b) the contemplation of rape, (c) aggressive behavior generally, and (d) aggressive behavior toward women particularly. Sex dolls are hence seen to be a valuable ally, and not a competitor, to women particularly in the 'war between the sexes' and to promote social harmony generally.

3. Discussion of the Prior Art

Dolls having selectively displayed alternative faces that achieve plausible human verisimilitude are uncommon. The most pertinent reference known in this regard is U.S. Pat. No. 5,971,763 issued to Yau Oct. 26, 1999 for a 'Method of Teaching, Training and Practice (of) Cosmetology Techniques and a Make-Up Mannequin Kit for Use Therewith' because this patent discloses the most accurate verisimilitude found in the prior art for 'selectively displayed alternative' human faces. This method, however, does not disclose a doll comprised of a complete figure: it discloses only a "make-up mannequin head":

> A cosmetology training, teaching and practice system, and a make-up mannequin kit, each characterized by provision of a soft skin make-up mannequin head having a body carrying an oval symmetrical facial configuration and plural soft skin flexible, elastic, resilient and stretchable companion mask members suitable for mounting upon the make-up mannequin head. Each of the companion mask members having, each of which is formed of size and shape conforming to the size of the make-up mannequin head and having a facial configuration identical (sic) to the facial configuration of said make-up mannequin head. Each companion mask member having a surface of skin tone and color representative of the skin tone and color of different plural human ethnic and racial origin(s). The selected companion mask is stretched to mount upon the make-up mannequin head and is sufficiently resilient to spring back in tight engagement with the facial configuration of the make-up mannequin head. The mannequin kit includes, in addition to the make-up mannequin head and companion masks, all the instructions, application implements and cosmetic compositions required for the teaching, training and practice of the cosmetology art along with a stand for mounting the make-up mannequin head and a carrier for holding and transporting the contents of the kit. (Abstract, recited in full)

It is noted that 'identical' means the same exact same element and that in the above recitation this results in a logical fallacy although the intended meaning is clear.

In a similar vein it is noted, more significantly, that "a body carrying an oval symmetrical facial configuration and plural soft skin flexible, elastic, resilient and stretchable companion mask members suitable for mounting upon the make-up mannequin head" does not refer to the 'body' of a doll as opposed to the head, as is hopefully clear from a reading of the full abstract and for which reason the same has been recited in full. In brief, Yau does not disclose a full or complete doll or mannequin but only a head and a plurality of masks therefor, along with 'make-up' accessories and carrier for all these system components.

Wigs are considered to be well known and it is also considered equally well known that wigs are an independent aspect to mannequins, many other dolls, and both women and men even if typically known as 'hair pieces' in the last case. Wigs are generally considered to comprise three types according to the source of the hair used: (a) genuine, human, hair; (b) animal hair, e.g. from a horse's tail; and (c) synthetic hair. The first is the most desirable and expensive and the last the most affordable. The purpose is generally the same: to provide the verisimilitude of an appealing abundance of 'natural hair' for the doll or person wearing the same.

With regard to figure toys having enclosed reinforcing or skeletal portions including a pivoted joint the most pertinent known prior art references are: U.S. Pat. No. 1,595,203 issued Aug. 10, 1926 to Leathers for a 'Toy and the Manufacture Thereof'; U.S. Pat. No. 2,129,421 issued to Hales Sep. 6, 1938 for a 'Mannikin and Method of Making Same; U.S. Pat. No. 3,628,282 issued to Johnson et al. on Dec. 21, 1971 for an 'Articulated Fashion Doll'; and U.S. Pat. No. 4,968,282 issued to Robson et al. on Nov. 6, 1990 for a 'Poseable Doll'.

Leathers discloses a doll with rubber skin, preferably dip molded, and sponge rubber, preferably vulcanized, interior encasing a rigid skeletal structure having joints. The joints preferably are 'friction hinges' made from stamped metal pieces with adjacent disc portions held together by a grommet or coil spring elements.

Hales discloses a "life-like figure of a manikin comprising a jointed skeleton covered with a flexible outer covering of sponge rubber or similar elastic material." (col. 1, lines 6–9) Ball and socket joints are used "in which the friction . . . may be controlled by adjustment so that the various members of the frame may be adjusted to different positions until moved" (col. 1, lines 11–16) "The skeleton is made of tubular metal frame-work of aluminum or similar light metal" (col. 2, lines 40–42) or other sufficiently strong, light, and rigid material. Coil springs internal to threaded tubular skeletal members are biased against the ball joints and adjustment of the resulting friction adjusted by varying the depth of the threaded engagement. A bilateral hollow shell portion for the chest and the abdominal regions is further disclosed. Hollow spaces about the tubular skeletal members are provided to facilitate freedom of movement within the rubber body.

Johnson et al. disclose an 'Articulated Fashion Doll': "with limbs that move in a lifelike manner." A "double ball-and-socket joint" "permits tuning and tilting of the head", "combined ball-and-socket and pin" joints are used in the shoulders and a "double-pin joint" (Abstract) is used for the wrists. Plastic is used for the body, the skin is vinyl. The legs have lateral ball and socket joints facilitating outward as well as forward and backward movement. And the feet have rachet joints facilitating positioning with low or high heels.

Robson et al. disclose a 'poseable doll' having ball and socket joints for the head, arms, and legs distinguished by trapping the skin in these joints with a snap ring.

In consideration of the prior art it is lastly noted that substantially full size dolls specifically intended for adult male sexual release are known ranging from inflatable 'love dolls' to very sophisticated and expensive products having full articulation and excellent verisimilitude of the human female figure. The first known manufacture of this last category is known as the 'Real Doll' and was invented, but not patented, by the present inventor. It has since been imitated by other manufacturers.

None of these 'love dolls', however, permit selective display of alternative faces. This is considered a very serious defect with regard to proper consideration of any of these as prior art pertinent to the present invention and because the present inventor was the inventor of the first fully articulated 'love doll' this product, and direct imitations of it, are properly excluded from the pertinent prior art except in an historical context.

Statement of Need

In summary of the pertinent known prior art it is considered that substantially full articulation of body parts, tubular skeletal structure, hollow chest, and rubber encasement of articulated skeletal structure including pivoted and ball and socket joints that provide for anatomically accurate movement for full, complete, dolls are known to the prior art and that a mannequin type head system providing for the selective display of alternative faces possessing human verisimilitude is also known thereto. However, there are no dolls disclosed possessing a fully articulated skeletal structure encased in an rubber body further providing for the display of selected alternative faces possessing human verisimilitude.

Because the face is of great importance to attaining human verisimilitude and because it is considered desirable to be able to selectively display alternative faces upon a fully articulated doll thereby obtaining variation of appearance in a doll having both visual and postural verisimilitude a need for the same is hence recognized.

SUMMARY OF THE INVENTION

Objects of the Invention

The encompassing object of the present invention is the provision a doll possessing variable human verisimilitude inclusive of both posture and appearance.

A first auxiliary object of the present invention is the provision a doll possessing variable human verisimilitude in posture with skeletal simulation and possessing human verisimilitude in appearance variable with selectively displayed alternative faces.

A second auxiliary object of the present invention is the provision of a doll possessing variable human verisimilitude in posture and physical sensation with skeletal simulation encased in comparatively soft, resilient, material simulating flesh and skin also possessing human verisimilitude in appearance variable with selectively displayed alternative faces.

A first ancillary object of the present invention is the provision a doll possessing human verisimilitude in appearance, posture, and physical sensation variable with regard to facial genotype.

A second ancillary object of the present invention is the provision a doll possessing human verisimilitude in appearance, posture, and physical sensation variable with regard to facial characteristics.

A third ancillary object of the present invention is the provision a doll possessing human verisimilitude in appearance, posture, and physical sensation variable with regard to facial expression.

Other auxiliary objectives of the present invention include ease in the exchange of selectively displayed alternative faces, simplicity of construction, economic structure with regard to the variation of simulated hair and facial genotype, characteristics, and expression permitting selective display of alternative faces in the provision of a doll possessing human verisimilitude in appearance, posture and physical sensation.

Principles of the Invention

In achievement of the objects of the present invention stated above it is suggested that:

(a) a doll possessing substantially full human dimensions be provided possessing human verisimilitude in feel with an internal structure comprised of comparatively rigid members encased in soft, resilient, material;

(b) variable human verisimilitude in posture of said doll be attained by providing movable joints between said rigid members;

(c) variable human verisimilitude in appearance of said doll, and variation of facial genotype, characteristics, and expression, be provided with selectively displayed alternative face masks.

It is considered that, rather than the use of selectively displayed alternative face masks, selectively displayed alternative heads might be utilized and while this approach is considered to be satisfactory in fulfillment of the principles relating to the present invention the use of selectively displayed alternative face masks is considered, in brief, more economic. This is not to say the use of exchangeable heads is without merit. Greater ease in the obtainment of a greater variation in range of facial structure, and hence facial genotype, characteristics, and even expression, is recognized as being facilitated with the use of selectively displayed alternative heads rather than face masks.

However, the range of facial genotype and, to a lesser degree characteristics consistent to a selected genotype, are recognized as being restricted in human verisimilitude by plausible conformance with the body and head. Skin color is an obvious concern in this regard that is difficult to 'mix and match'. It is hence suggested that variation in fundamental genotype be provided with altogether different dolls having skin and other characteristics substantially consistent with each other and that the head be essentially standard with regard to the basic genotype.

It is emphasized that the variation of facial characteristics and expression within any basic genotype is limitless and that no other single factor is so determinative of the appearance of a human and hence a doll possessing human verisimilitude in appearance. It is considered no accident that cosmetics and 'health and beauty aids' generally are overwhelmingly concerned with the face and hair. It is noted that variation of simulated hair on a doll in accordance with principles relating to the present invention is also intended but that this aspect is well known in the art and is simply assumed in the present discussion.

It is suggested that the body of the doll, including the neck connecting the head to the torso, and also most particularly including the jaw, possess full articulation commensurate with the range of movement typically found in a human. In variation of facial expression opening and closing of the mouth is considered to present readily evident value. In clarification of a principle term of nomenclature already extensively utilized herein, i.e. fully articulated, it is remarked that for purposes herein, this term primarily indicates the physical connections required of an interior rigid structure, herein known as a skeleton or skeletal structure, between rigid members thereof permitting movement of the various parts of the doll in verisimilitude of the range of movement of which the human body is capable.

Two basic approaches are suggested in this regard: ball and socket or pivots. In brief while ball and socket joints, particularly for the hips and shoulders, will satisfactorily fulfill this aspect of a doll in accordance with the principles relating to the present invention the use of pivoted connections in simulation of human joints between bones or rigid skeletal members is generally considered superior. Some joints including the jaw in particular, are hinged in a human and hence pivots more readily provide human verisimilitude with regard to variation of posture for these skeletal joints or connections.

With regard to joints that in the human body are of ball and socket construction combination pivots are still considered superior primarily because of greater ease in providing the same with a resistance to displacement of the connected skeletal members more accurately approximating the human body. Combination pivots include hinges and rotating pivots. Friction can be readily adjusted in both with a threaded engagement between apposed surfaces of a stationary joint member trapping a rotating member or of two adjacent members of a hinge. A block can be used as a stationary member in either case, slotted in the case of a hinged pivot, with a shaft inserted into a cylindrical bore therethrough for a rotary pivot. Washers of appropriate material including Delrin® are suggested.

With regard to the specific construction of the skeleton it is suggested that aluminum tubing or other similarly rigid comparatively lightweight material be utilized generally and for the spine, hips, and lower legs and lower arm portions particularly for strength in relatively narrow areas including the ankles and wrists. Polyvinylchloride (PVC) tubing with aluminum cylindrical inserts for connection to the joints is suggested for the upper arms and legs where light weight and a degree of resiliency is desirable and sufficient limb thickness available.

It is further suggested that hollow areas be used in the areas corresponding to the lungs and that medium density polyethylene or other suitable lightweight and resilient material be molded about the skeleton in simulation of flesh. A more durable, e.g. denser polyethylene or PVC, material is suggested for simulated skin or a chemical, thermal, or that other treatment be given to the exterior surface of the resilient material used in simulation of the flesh to obtain a smoother, less porous, more durable skin thereto. It is most specifically suggested that the resilient material used in simulation of flesh be vulcanized to obtain the desired exterior surface or skin characteristics. It is also specifically suggested that the resilient material used in simulation of flesh, and the molding process, achieve a contraction of the material in cooling so that some open space or clearance about the interior skeleton is obtained facilitating movement of the skeletal members.

It is suggested that the head or skull, however, be constructed in epoxy or other suitably lightweight but rigid material that is readily molded without vulcanization and that the face masks be constructed of an air cured synthetic silicone with an open mold. It is further specifically suggested that eyebrows and lips be appropriately colored with stained air cured synthetic silicone painted upon the molded mask and that a clear coating of lacquered air cured synthetic silicone be applied over the exterior surface of the mask to seal porosities and obtain an attractive surface sheen not dissimilar to the surface of the doll body. It is, of course, suggested that skin color tone by obtained with dyeing of the materials utilized and that face masks and bodies be matched in this regard.

It is specifically suggested that the face mask be fastened to the skull by Velcro® although resilient ball and sockets or any other type of fastening will fulfill this aspect of the principles relating to the present invention. Similarly, it is suggested that simulated hairpieces, i.e. wigs, of conventional manufacture be attachable with Velcro® or any other suitable fastening means. It is emphasized that a wide variety of colors, lengths, and styles of wigs be made available in variation of the appearance of a doll in accordance with the principles relating to the present invention but that this is well known in the art and it is the capability of fastening a variety of selectively displayed alternative face masks providing a wide variety of facial characteristics and expression possessing good human verisimilitude that is considered most essential to said principles.

It is suggested that the eyes, lastly with regard to specifically suggested construction, be of high quality manufacture in acrylic, glass, or other suitably transparent and glossy surface material, colored substantially white about the iris, with black pupils. It is suggested that the irises by reproduced using photographic techniques but emphasized that the eyes be purchased from existing manufacturers and it is not pretended that construction of the same is fully understood.

Most importantly with regard to the eyes and construction of a doll in accordance with the principles relating to the present invention it is suggested that the face mask be molded with the eyes in position and that the cavities or eye sockets therefor be automatically achieved. With eyes of much harder material than the face mask movement of the eyes within the sockets is easily obtained. A coating of petroleum jelly or other suitable lubricant given to the eyes prior molding of the face mask readily and easily ensures that the eyes can be moved within the sockets. Movement of the eyes with mechanical or electromechanical means is also suggested. Manual controls protruding from the back of the skull are readily hidden by a wig and operated during a natural caress. It is also suggested that the jaws be movable by mechanical means with similar manual controls. Electromechanical operation of the eyes or jaws is readily effected with an appropriate mechanism interior to the skull.

Other suggestions include the addition of voice, most particularly, with a recording device located in the skull accessible through a hinged skull cap to facilitate variations as desired. Use of conventional recording technology will facilitate improvisation on the part of the customer and greater ease in the provision of a wide range of voices and content by any interested manufacturer. This aspect is considered, to an extent, similar to wigs and eyes in that components available from other manufacturers are expected to be utilized and the customer may readily avail themselves of the same in personal customization and extension of the variety of human verisimilitude obtainable with a doll in accordance with the principles relating to the present invention.

NOMENCLATURE

| | | | | | |
|---|---|---|---|---|---|
| 10 | doll | 30 | mouth | 60 | jaw displacer |
| 11 | body | 31 | jaw | 61 | mechanism |
| 12 | skeleton | 32 | rigid member | 62 | lever |
| 13 | face | 33 | face mask | 63 | audio device |
| 15 | simulated flesh | 35 | pelvis | 65 | electric motor |
| 16 | simulated skin | 36 | vulva | 66 | power source |
| 17 | head | 37 | neck | 67 | battery |
| 19 | torso | 39 | hollow | 69 | electrical cord |

-continued

NOMENCLATURE

| | | | | | |
|---|---|---|---|---|---|
| 20 | movable joint | 50 | fastener | 70 | socket |
| 21 | hinged joint | 51 | hooked fabric | 71 | ball |
| 22 | rotary joint | 52 | looped fabric | 72 | ears |
| 23 | simulated skull | 53 | eyebrows | 73 | skull cavity |
| 25 | smooth membrane | 55 | eyelashes | 75 | nose |
| 26 | fluid receptacle | 56 | artificial eyeballs | 76 | eye sockets |
| 27 | arm(s) | 57 | wig | 77 | wig attachment |
| 29 | leg(s) | 59 | lips | 79 | cheek structure |
| 90 | hand(s) | 91 | chin | 92 | hinged pate |
| 93 | bosom | 96 | eyeball mover | 97 | nape (of neck) |

DETAILED DISCUSSION OF PREFERRED EMBODIMENT

Figure 1:
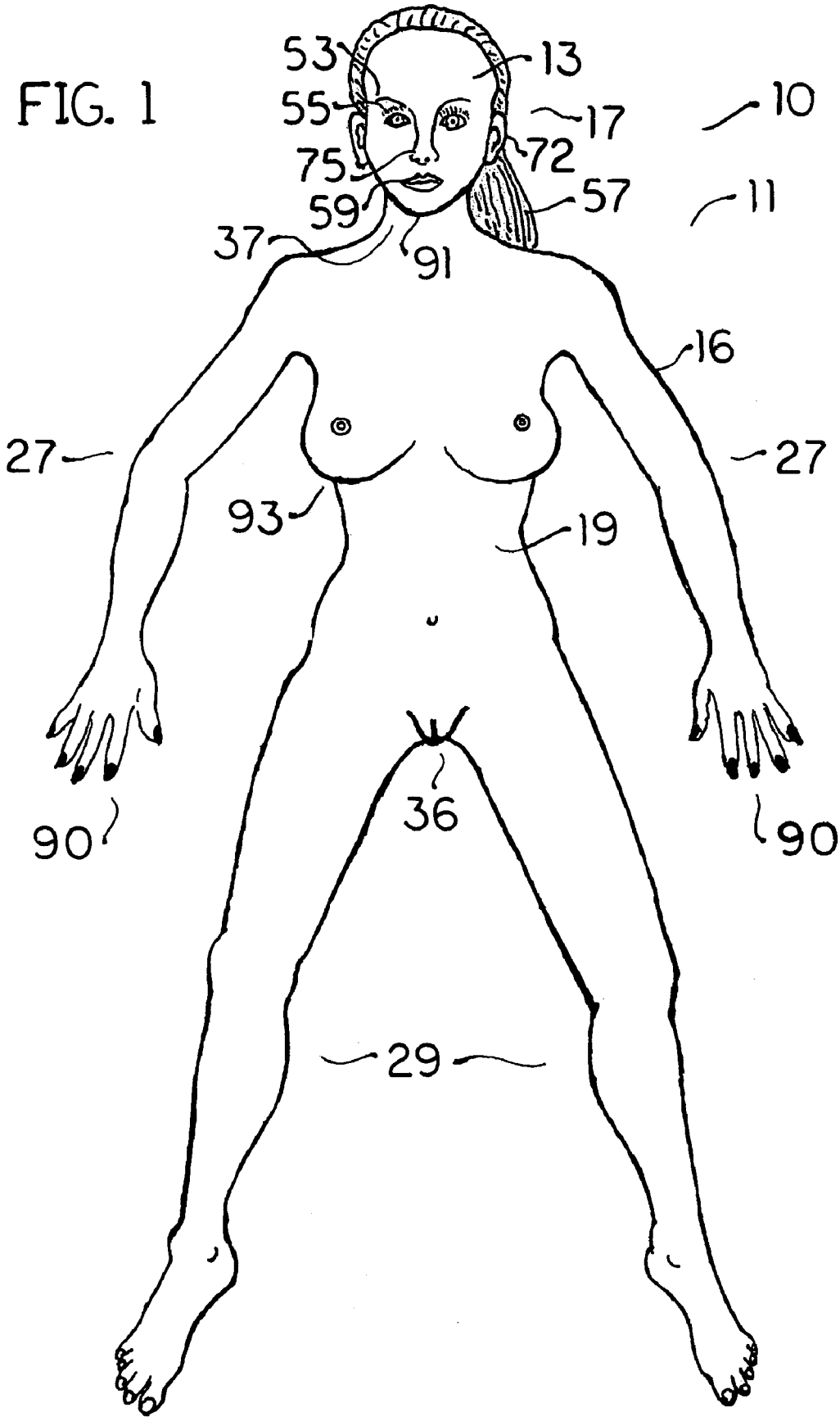
FIG. 1 is a plain elevational view taken from the front of a preferred embodiment of the principles relating to the present invention: a full size fully articulated doll with selectively displayed alternative faces.
Figure 2:
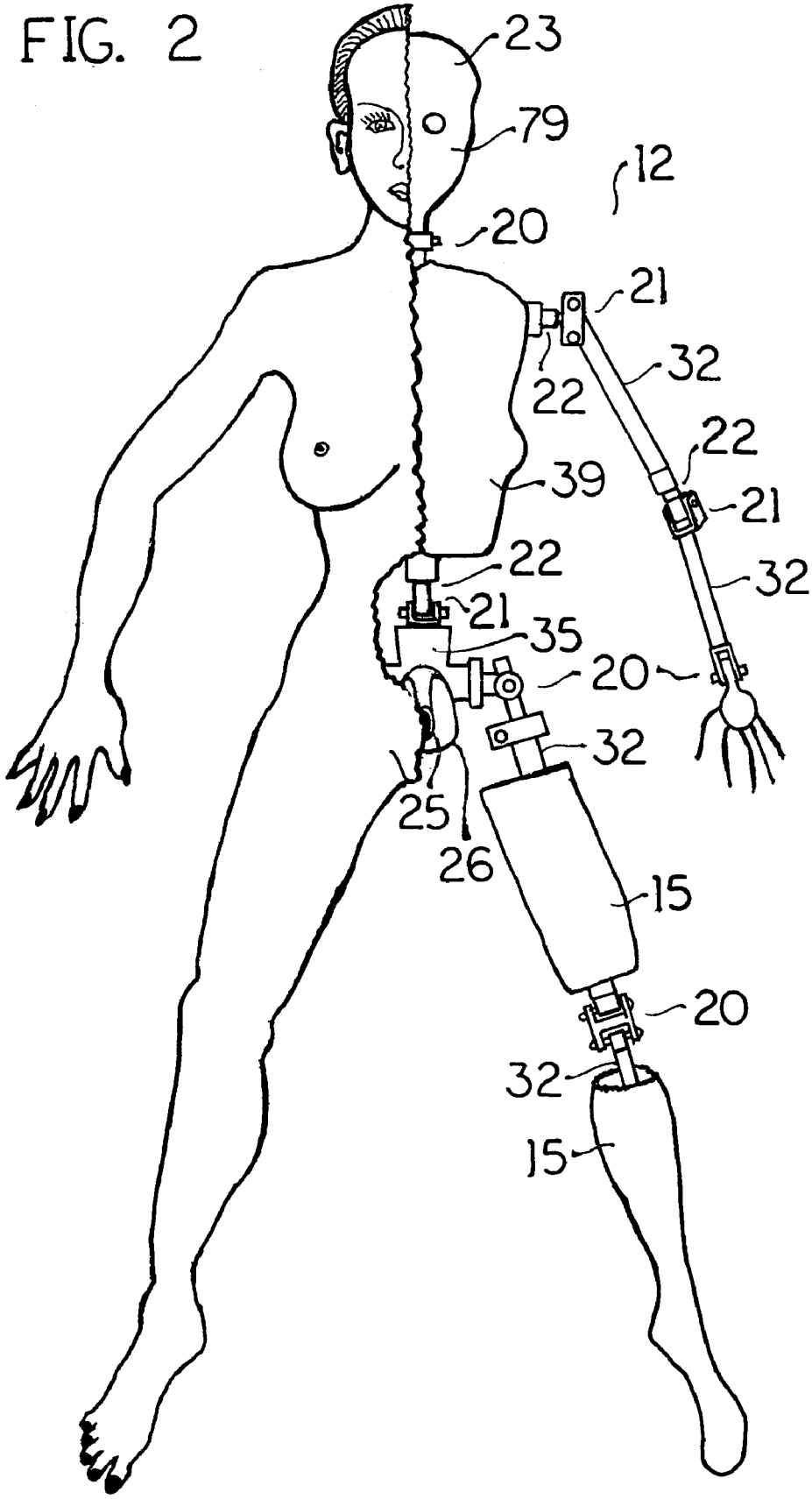
FIG. 2 is a medially cut away frontal view of the full size fully articulated doll with selectively displayed alternative faces depicted in FIG. 1 illustrating the internal skeleton and other aspects of preferred construction.

The full doll 10 depicted in FIG. 1 preferably possesses, for reasons discussed before in summary of the principles relating to the present invention, variable human verisimilitude in appearance in addition to variable human verisimilitude in posture. In achievement of both the full doll 10 possesses a full complement of articulated limbs and looks and feels like a human. The body 11, comprising essentially everything to the doll 10 but the head 17, possesses a life-like and pleasing form as seen in FIG. 1 and is constructed of appropriate materials as seen in FIG. 2 including a skeleton 12 comprised of rigid members 32 connected by movable joints 20.

Variation of appearance, as discussed earlier in summary of the principles relating to the present invention, is most easily affected with a change of the face 13 because the face 13 is the most important component of human appearance. As earlier mentioned there are essentially two ways of changing the face 13 of a doll 10 in accordance with the principles relating to the present invention: changing the head 17 or changing a face mask 33 such as those shown, respectively, in FIGS. 8 & 3. The latter is preferred because it is more economic, as mentioned earlier, but changing the head 17 more easily achieves a larger change in appearance particularly an ethnographic change. It is further desired, however, to maintain congruence between the face 13 or head 17 and the body 10 in order to maintain verisimilitude of human form and a drastic change in the appearance of the face 13 or head 17 is likely to destroy this. Differing skin color, or the color of the simulated skin 16, between face 13 and body 10 is an obvious detriment to verisimilitude. Similarly, other physical characteristics that are less easily defined, are preferably maintained in consistency between the face 13 or head 17 and the body 10.

This aspect of preferred embodiment in accordance the principles relating to the present invention has been touched upon before in summary of said principles in relation to different genotypes. A person of Scandinavian ancestry possesses an appearance much different than one of Chinese ancestry for example. But the difference, for a doll 10 in accordance with the principles relating to the present invention, other than the color of the simulated skin 16 or artificial eyeballs 56, wig 57, lips 59, eyebrows 53 and eyelashes 55 is not easily defined. The shape of the simulated skull 23, particularly that together with the simulated flesh 15 forming the ears 72, nose 75, eye sockets 76, and cheek structure 79, is considered to be readily appreciated as important to recognizing and hence, in manufacture, representing various genotypes consistently in order to obtain plausible verisimilitude of a human figure; but other ostensibly more prominent features, such as the size of the bosom 93, or hips, buttocks, and relative length of the legs 29 tend to vary so widely within a given genotype that these attributes are considered to be independent, of genotype consistency.

A large bosom 93, as seen in FIG. 1, is generally considered more attractive in the female human form regardless of genotype but the shape of the breasts comprising the same is generally recognized as being of greater aesthetic value than mere size. And the shape of the breasts is generally correlated, regardless of genotype, to the feel of the same. This, along with other physical attributes such as the buttocks and thighs, vulva 36, and lips 59 generally correspond to age and physical condition with firmness associated with youth and good physical condition and flaccidity with age or obesity. It is noted that the sexual drive in humans has a purpose, biologically, and that aesthetics are derived from evolutionary factors. Men who are attracted to excessively aged, young, or physically infirm women will not achieve reproduction and hence the attributes of a physically capable woman of an age still to bear many children are seen to be biologically programmed, as it were, in the male.

A large and relatively firm bosom 93 is indicative of robust mammary glands necessary, prior to the modern age, to feed a large succession of infants. With regard to the present invention it is emphasized that the shape and feel of the body 11 is preferably consistent with what is generally considered attractive to men because the obtainment of sexual release with a doll 10 in preferred accordance with the principles relating to said invention is fundamental to said invention. And, with more particular regard with preferred embodiment, it is noted that biologically men are programmed to achieve impregnation of as many different women as possible. Exogamy, in brief, is a biological virtue; it is the opposite of inbreeding. Therefore, in order to obtain success in providing sexual release for a human male variety of appearance especially by variation of the appearance of genotype, is recognized as being of great significance.

And, since the face 13 is the most expressive aspect to the human form, variation of the same achieves the greatest result with the minimum effort or expense. Many attributes to the body 11 considered attractive regardless of genotype for evolutionary reasons as discussed above and are preferably optimized with regard to generally prevailing tastes as determined biologically with use of appropriate materials and design: i.e. construction and craft or art; and while subject to variation in order to provide variety and hence interest are generally considered to be uneconomic in individual variation in comparison with variation of the head 17 or face 13, particularly. Economic variation of the appearance of the face 13 in a doll 10 possessing postural and visual verisimilitude is hence considered the primary means of obtaining a variety of appearance appealing to male sexual desires and fantasies. But it is still vital that the body 11 of the doll 10 possess visual, postural, and palpable verisimilitude with a female human figure and this is achieved in preferred embodiment of the principles relating to the present invention as detailed below.

As seen in a comparison of FIGS. 1 & 2 the body 11 of a doll 10 in preferred accordance with the principles relating to the present invention possesses an attractive figure achieved by appropriate construction using appropriate materials and includes an articulated skeleton 12 upon about which simulated flesh 15 is molded. The mold for this is not shown in the drawings attached hereto because it is preferably just a two part mold with the part line comprising the sheet of FIG. 1.

Figure 7:
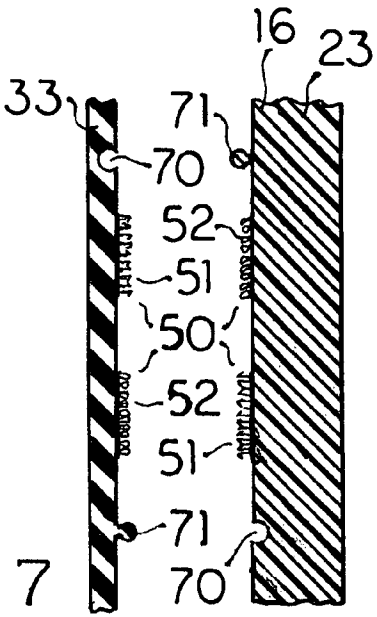
FIG. 7 is a cross sectional view of a marginal portion of a face mask and the congruent portion of a simulated skull depicting two different types of fasteners suggested for attaching the former onto the latter.
Figure 3:
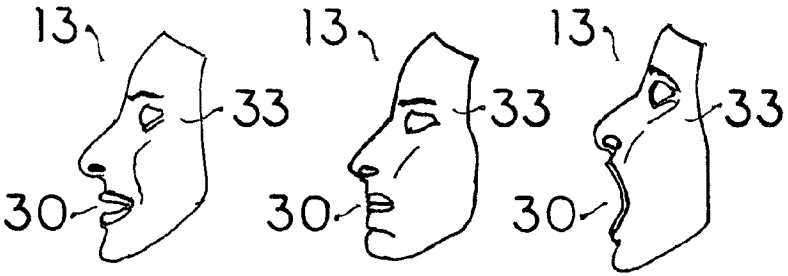
FIG. 3 is a plain elevational view taken from the side of three different faces of the same genotype, each possessing a different facial expression shown serially spaced apart from each.

The rear of the doll 10 is also absent from the drawings attached hereto because the primary purpose of the present invention, provision of alternative faces 13 as seen in FIGS. 3 & 7 for the doll 10, does not concern the rear of the doll 10. A view of the rear of the doll 10 is also wholly unnecessary for one practiced in the art to obtain a detailed understanding of the best known method and manner of making a doll 10 in preferred accordance with the principles relating to the present invention. It is sufficient to note that the rear of the doll 10 possesses visual and palpable verisimilitude with an attractive human female form. The simulated skin 16 and simulated flesh 15 is the same as that used on the front of the doll 10 and the only noteworthy if not obvious feature is considered to comprise the buttocks which are simply constructed with an ample amount of simulated flesh 15 to attain the desired verisimilitude in shape and feel.

The shape is determined by an interior cavity of the mold used that is the exact negative of the positive exterior form of the doll 10 obtained thereby. It is also noted that the preferred mode of manufacture, i.e. molding about the articulated skeleton 12, inhibits but does not preclude by any means the variation of components such as the buttocks or bosom 93. These two components in particular are considered to be readily varied with a separate molding for each that is simply attached to a doll 10 lacking these components with appropriate fastening means such as the resilient ball 71 and socket 70 seen in FIG. 7.

Figure 5:
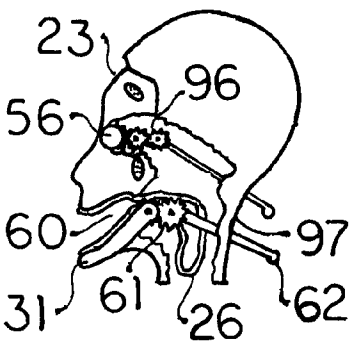
FIG. 5 is a partially cut away side view of the head depicted in FIG. 4 illustrating a mechanism for displacement of the jaw and artificial eyeballs along with a fluid receptacle behind and below the jaw.

It is also noted that these two components or features, i.e. the buttocks and most particularly the bosom 93, are preferably softer than the balance of the body 12 except, of course for the vulva 36 and mouth 30, both of which, in accordance with the verisimilitude required in feel, particularly, are preferably made of relatively soft, pliant, flexible material inclusive of silicone rubber. The intended function of the doll 10, moreover, suggests that vulva 36 and mouth 30, as seen in FIGS. 2 & 5, and anus (not shown) have at internal termination, a fluid receptacle 26 that is easily cleaned, preferably removable from the doll 10, and preferably made of a smooth membrane 25 overlapping, or contiguous if not continuous with, the smooth membrane 25 most preferably lining these anatomical cavities.

The skeleton 12, as seen in FIG. 2, is comprised of a plurality of rigid members 32 connected by movable joints 20 generally in approximation of a human one but much simpler in order to achieve economy in manufacture. As discussed in summary of the present invention above ball and socket movable joints 20 for the hips, or connection of the legs 29 to the pelvis 35, as well as the shoulders, or connection of the arms 27 to the upper torso 19, is satisfactory but combination pivoted movable joints 20 comprised of both a hinged joint 21 and a rotary joint 22 are preferred as more economic. More importantly, these are more easily set to the desired resistance to movement providing verisimilitude in movement of the limbs. It is most particularly suggested that a split collar clamp be used on the rotary joints 22 for this purpose and that the hinged joints 21 utilize bolts, nuts and washers to apply, through the nuts or opposed bolt head, compression upon overlapping spaced apart pairs of pivoted joint 21 plates or extensions with apertures through which the bolts extend laterally and hence act as the pivot axis. Mild, i.e. hot rolled, steel or aluminum plate is recommended for the pivoted joints 21 while concentric tubes of the same material are recommended for the rotary joints 22 with purchased steel hardware for both.

Tubes are also suggested for the rigid members 32 connected by these movable joints 20 but plastic, specifically PVC, is preferred for economy in larger diameters including the thighs or upper legs 29, upper arms 27 and rigid members 20, if used, for an approximation of a backbone running centrally in the back of the torso 19 from the pelvis 35 through the neck 37 to the head 17 or simulated skull 23 which is preferably molded of epoxy about the top of the neck 37, including the nape 97 thereof, or an upper terminal movable joint 20 thereof. The simulated skull 23 is also an interior positive portion of a face mold for the face mask 33 which is preferably molded from silicone rubber with a single cavity opposed exterior face mold portion taken from a human face. This is spaced apart from the positive portion a distance desired for the thickness of most of the face mask 33. The lips 59, nose 75, and, if desired, ears 72 are preferably thicker and formed mainly by the single cavity of the exterior face mask 33 mold portion. Ears 72 are preferred but not strictly necessary because these can easily be covered by a wig 57. Ears 72 with complete anatomical accuracy, i.e. taken from a real human face, are not very easily molded because of the inclusions but good approximations are preferred to obtain complete visual verisimilitude.

In completion of the skeleton 12 it is recommended that one large or two bilateral hollows 39, preferably of relatively light material: e.g. low density polyurethane; be provided inside the torso 19 corresponding in location and approximate lack of weight possessed by the lungs of an adult human. It is preferred that the jaw 31 be hinged to provide the basic movement of opening and closing. The jaw 31 is hence preferably a separate component movably attached to the balance of the simulated skull 23. The range of motion preferred is essentially that of a human's, as is the range of motion of all the movable joints 20 of the skeleton 12, and that of the jaw 31 is reflected in FIG. 3 with the several degrees of mouth 30 openings seen therein: closed, partly open, and wide open.

FIG. 3 depicts several different face masks 23 each possessing a different expression, in addition to a different degree of opening of the mouth 30. These various expressions exemplify a manner of variation in facial characteristics, or face 13, that has been hitherto unmentioned: mood. The point is that the same human face 13 possesses a wide variety of expression and this variation provides verisimilitude of a human figure. It also reflects a complexity in human relations. A person may seem to be flirtatious in manner and face 13, as hopefully depicted in the left most face mask 33 in FIG. 3, while feeling frustrated as depicted in the medial face mask 33 in this figure, and subconsciously, as depicted in the right most face mask 33 in these two figures, true rage or anger.

This is considered to relate to the psychological aspects involved in the main purpose of the principles relating to the present invention. Humans are very complex and the emotions are often poorly understood. Most pertinently, as mentioned before in summary of said principles, the male sexual drive is almost inseparable from aggression because the male is essentially competing with other males for the favor of a female and the male hormone testosterone facilitates this mechanism. The female, conversely, wants the strongest mate for her children to ensure their survival and is placed in contention with other females but identifies with them and thus resents the need for a man. Society subordinates these primal instincts and forces the ego to mask the id while being mediated by reason. As represented in FIG. 3 a set of three female face masks 33 depict the societal urge to please or behave socially on the left, rage at the biological clock diminishing her chances of producing children on the right, and frustration with the whole situation or the conflict between what is necessary socially to raise a family: i.e. marriage and proper behavior. What she feels inside and is motivated by, subconsciously, is a primal act of aggression or violence on the part of the male to demonstrate that he is capable and hence worthy of her affection.

Figure 4:
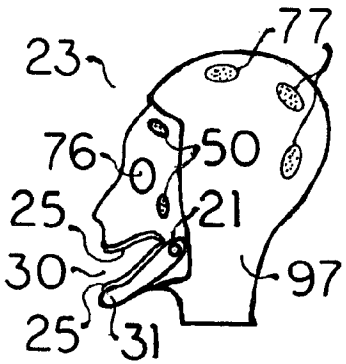
FIG. 4 is a plain elevational view taken from the side of a head possessing a configuration consistent with the genotype of the faces depicted in FIG. 3 and upon which each of said faces is readily attached.

Returning now to the mechanics of fulfillment of the principles relating to the present invention in detailed discussion of the best manner known it is first noted that the heads 17 depicted in FIGS. 4 & 5 are somewhat different as are the face masks 33 for these. The three face masks 33 depicted in FIG. 3 lack ears 72 and eyelashes 55 while the single face mask 33 depicted in FIG. 8 includes these features. Both figures depict face masks 33 inclusive of the chin 91, lips 59, cheek structure 79, nose 75, and eyebrows 53. And regardless of the features included the face masks 33 each match a head 17 such as that depicted in FIG. 4 and are attachable to the same with a fastener 50.

It is preferred that hooked fabric 51 attaching to looped fabric 52 be utilized, i.e. hook and loop fastening or Velcro® and that patches of either be glued onto a head 17 as seen in FIG. 4 that mate in attachment with patches of the opposed hook or loop fabric 51, 52 on the inside of the face mask. It is wholly immaterial as to which fastener 50 is located on the interior of the face mask 33 and which upon the frontal exterior of the head 17 except, in consideration of the greater wear expected upon the looped fabric 52 and the expectation that multiple face masks 33 will be utilized upon the same head 17, it is suggested that the looped fabric 52 be located on the former and the hooked fabric 51 on the latter. It is also noted that the two can be mixed with patches of both looped fabric 52 and hooked fabric 51 on both, always mating in opposed pairs, of course.

Figure 8:
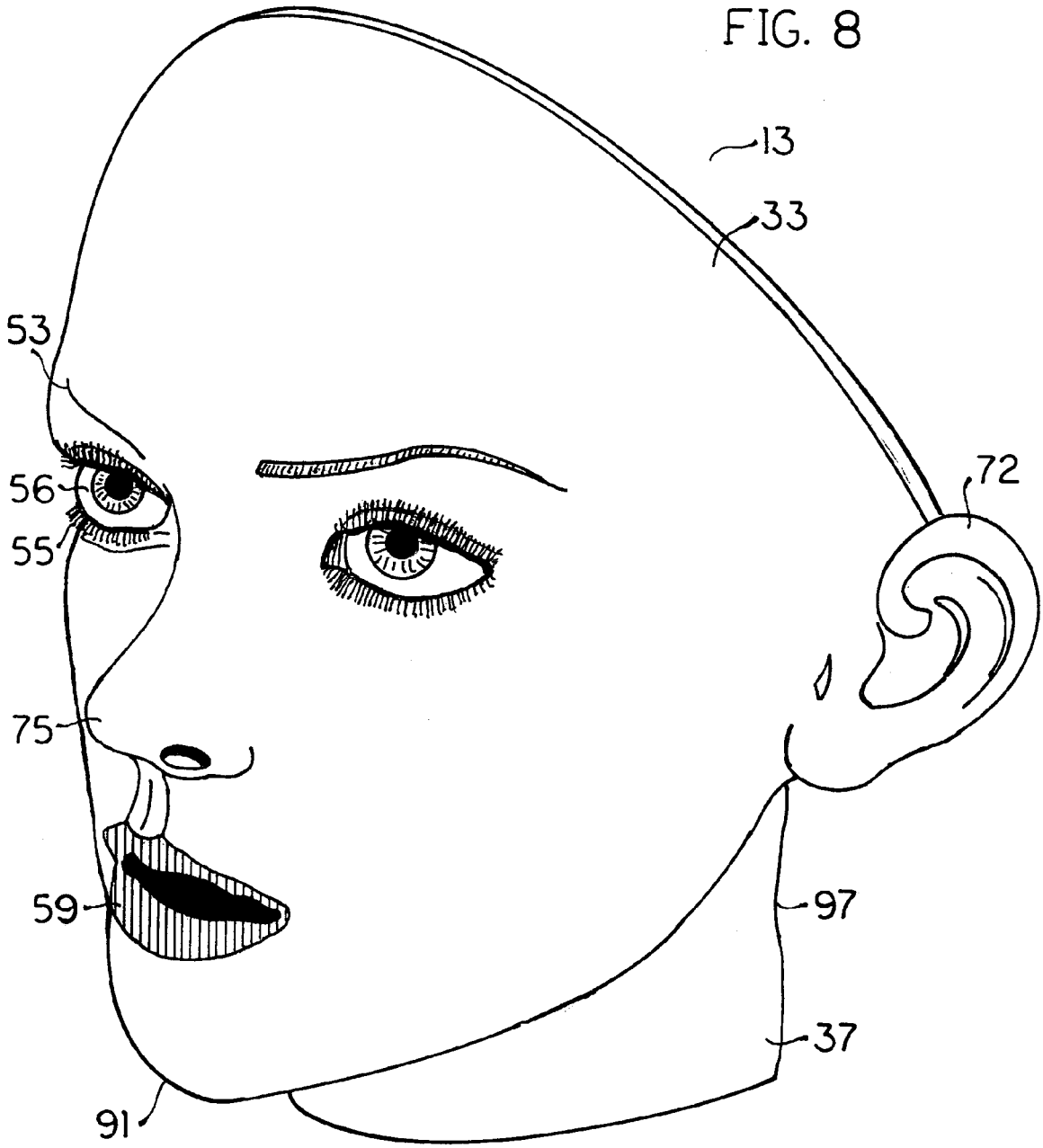
FIG. 8 is a plain elevational view taken from the front of a full face mask inclusive of ears and eyelashes depicting in enlarged detail the face of FIG. 1: a different genotype from that of the face masks depicted in FIG. 3.

Most importantly in this regard it is not necessary that the fastener 50 utilized be of hooked and looped fabric 51, 52. As seen in FIG. 8, depicting both mating hooked fabric 51 and looped fabric 52 and mating ball 70 and socket 71 fasteners 50, any fastener 50 permitting removal and replacement of a face mask 33 from and upon a head 17 may be utilized in fulfillment of the principles relating to the present invention. It also noted, once again, that the head 17 itself can be exchangeable upon the body 11 if desired.

If the head 17 is be removable from the body 11, the neck 37 can go with either but preferably remains with the latter as being more economic with use of multiple heads 17 which can also be constructed to permit exchange of various face masks 33. The head 17 depicted in FIG. 4, for example, is constructed to permit any of the face masks 33 depicted in FIG. 3 to be attached thereto while the more extensive and hence costly face mask 33 depicted in FIG. 7 including also ears 72 and eyelashes 55, is intended as a more detailed view of the face 13 seen on the doll 10 depicted in FIGS. 1 & 2. The doll 10 depicted therein has a head 17 preferably attached permanently to the torso 19 through an articulated neck 37 wherein the face 13 alone is detachable and hence exchangeable for another. The head 17 depicted in FIG. 4, conversely, is intended to be a replacement for that on a doll 10 in accordance with the principles relating to the present invention as depicted in FIGS. 1 & 2 with this one difference.

The only difference required is means of removing the head 17 and the presence of a part line about the juncture. The head 17 could screw off and on the neck 37 or the latter, being continuous with the former, screw off and on the top of the torso 19. Other means of attachment are readily devised by the routinier including cam lock, laterally run threaded engagement, et cetera that would involve a mechanical protrusion or hidden access. The simulated skin 16 will necessarily be parted at the part line between the head 17 and neck 37 or neck 37 and torso 19, with the former preferred as earlier mentioned, and can simply be left loose on one side or the other to be pulled back and reveal the mechanism utilized. Or a ball 71 and socket 70 arrangement can be utilized similar to that shown in FIG. 7 as an alternative fastener 50 for a face mask 33 to the head 17. There is a part line involved here, also, which is largely obscured by a wig 57 as seen in FIG. 1 and only detectable at the top thereof in FIG. 2.

The reasons for the part line between a fitted, attached, face mask 33 and a head 17 fitted being nearly invisible are actually manifold, however, as the wig 57 cannot be relied upon to obscure a palpable part line. First of all, if the face mask 33, as seen in FIG. 8, is inclusive of the ears 72 and has a lower termination below the chin 91 but above the neck 37, the lower part line when fitted is largely obscure to a frontal view because the neck 37 is of lesser width than the face mask 33 which projects inwardly behind the chin 91 and below the cheek structure 79. Secondly, and more importantly, the head 17, as most clearly seen in FIG. 8 but also discernable in FIGS. 2 & 4, is comprised of a simulated skull 23 and simulated skin 16 covering the former at least in the marginal areas against which the face mask 33 abuts. There is hence, preferably, no palpable difference in the height across the line separating the two and hence no possibility of a shadow divulging to the eye the line concerned.

It is noted, further, that if the face mask 33 is sized for the head 17 with the jaw 31 shut to butt its edge against that of the simulated skin 16 of the head 17 opening of the mouth with displacement of the jaw 31 downward will only force the abutted edges of face mask 33 and simulated skin 16 against each other and that a little slack in attachment of the face mask 33 to the simulated skull 23 or head 17, i.e. lack of attachment within the margin adjacent the abutted edge, not only facilitates wrinkling of the face mask 33 margin but also facilitates the insertion of fingers underneath for removal of the face mask 33. With regard to displacement of the jaw 31 it is intended that at least one of several options be provided. Most simply the jaw 31 can be displaced directly, manually, with a hand upon the same and another upon the fore or other part of the head 17. The face mask 33 preferably possesses sufficient flexibility to permit opening of the mouth fully in this manner. Silicone rubber is the most preferred material for the face mask 33 and for the simulated skin 16.

With regard to materials the skeleton 12 has been discussed above and the use of low density plastic has been recommended for the area that simulates the lungs. It is emphasized that any lightweight material or cavity will suffice for this hollow 39. Silicone rubber has also been recommended for the simulated skin 16 and it is further recommended for the smooth membrane 25 preferred for the lining of the vulva 36 and the mouth 30. It is also recommended for the anus as is a fluid receptacle 26 for these three orifices. Silicone rubber is further recommended for the buttocks and the bosom 93, but other materials will certainly by satisfactory. Saline or water filled hermetically sealed sacs of any suitable plastic are also suggested for the breasts of the bosom 93 especially for the same reason that these are used in breast implants in women: a verisimilitude in shape and feel is obtained. This is the guiding rule in construction of a doll 10 in accordance with the principles according to the present invention: verisimilitude in shape, feel and, of course, appearance.

The face 13 provided by the face mask 33 or replacement head 17 is of primary concern to the present invention. It has been recommended above that the face mask 33 be made of silicone rubber and that the simulated skin 16 on the head 17, as well as elsewhere upon the body 11 be of silicone rubber. Other materials will suffice, particularly for simulated skin 16 on the body 11 that does not require much flexibility or chemical resistance. The faces 13 and smooth membranes 25 require flexibility and resistance to chemicals, especially soap, is desired of these parts to enhance durability and cleanliness. It is mentioned in this regard that silicone rubber is the best known material in these regards and that silicones generally are classified as inorganic plastics because of the absence of carbon: the element silicon replaces. But "silicones are high in cost . . . premium plastics" (Brady & Clauser, *Materials Handbook,* 13$^{th}$ Ed., McGraw Hill, Inc., 1991, p. 747) and other plastics will suffice for most of the simulated skin 16.

It is also mentioned that 'ordinary silicone rubber consists of a repeating group of H—$CH_2$—Si—$CH_2$—H "connected with oxygen linkages, but in the nitrile-silicone rubber one of the end hydrogen of every fourth group in the repeating chain is replaced by a C:N radical" and these "polar nitrile groups give a low affinity for oil, and the rubber does not swell with oils and solvents" while fluorosilicones, conversely, are "incompatible with petroleum oils" (Ibid, pp. 748–49) and are hence not recommended as lubricants very often are made from petroleum. Vulcanized rubber is considered essentially equivalent to silicone rubber for the purposes of the present invention.

Resilience is desired of the simulated flesh 15 but chemical resistance is unnecessary and less expensive materials than silicone rubber are perfectly satisfactory with medium density polyurethane including polyurethane foam being specifically recommended for its resilience, stability, flexibility, and palpable verisimilitude with human flesh. Urethanes "are attacked by hot water, polar solvents and concentrated acids and bases" (Ibid., p. 874) and are hence not recommended for the smooth membranes 25 expected to be regularly cleansed. It is noted that urethanes are based on polyether or polyester resin and that urethane foam is manufactured in a wide range of densities: 1–5 pounds per cubic foot. The denser grades more closely approximate the density of human flesh but it is also desired that a doll 10 in accordance with the principles relating to the present invention have an overall weight that is considerably less than an actual human of the same size and hence a medium density urethane is recommended along with the use of PVC tubing and one or two hollows 39 in place of the lungs.

The hands 90 preferably have articulated fingers and the artificial eyeballs 56 are considered to be very important to obtaining human verisimilitude in the face 13. Excellent quality artificial eyeballs 56 made of glass or hard plastic with photo process reproduced irises are specifically recommended.

Wigs 57 have also been discussed and are simply a purchased component although the cost, especially for larger human hair wigs, can be very great and it is hence recommended that a doll 10 in accordance with the principles relating to the present invention possess a head 17 to which readily available wigs 57 can be easily attached. Provision of hooked fabric 51 patches on the exterior of the head 17 in appropriate places is specifically recommended although it is noted that if the head 17 simply possesses human verisimilitude in shape a wig 57 for humans can readily be adhered to the same with rubber cement and there are many alternative means of removably fastening a wig 57 to the head 17. It is recommended that the eyebrows 53, lips 59, and any other coloring desired of the cheeks, for example, be painted on the face mask 33 using silicone rubber that has been 11 appropriately dyed and treated with solvent so that evaporation of the latter leaves a relatively permanent colored feature. Synthetic, i.e. 'fake' eyelashes 55, are readily attached with applied layers of silicone rubber and a lacquered clear coat of the same applied to the exterior surface of the face mask 33 lends an attractive sheen yielding an excellent human verisimilitude while also protecting the 'painted' eyebrows 53, lips 59, and any other coloring desired.

It has been previously mentioned that a movable, preferably hinged, jaw 31 is desirable and that at least one of several means be provided for the same while only manual displacement was discussed above. It is first elaborated upon this means that an amount of resistance is desirable at least sufficient to maintain the jaw 31, and hence the mouth 30, in the position or degree of openness obtained manually and that manual adjustment be necessary to alter the position so obtained. It is further commented that this degree of resistance or resilience is considered desirable in all the movable joints 21 of the skeleton 12 of which the jaw 31 is but one.

With regard to other means of jaw 31 displacement, other than manual, it is recommended that a jaw displacer 60 be considered and that one of two types specifically be implemented if desired: a mechanism 61 or an electric motor 65. It is first noted in this regard that a mechanism 61 will be necessary in the jaw displacer 60 even if an electric motor 65 is utilized but, for the sake of simplicity, the former is distinguished over the latter by use of a manual activated lever 62, as seen in FIG. 5, preferably located, as seen therein, to extend from the nape 97 of the neck 37 where it is expected to be normally hidden by a wig 57 of sufficient length and where it is further conveniently located for manipulation by one hand in a posture of caress. An eyeball mover 96 is also seen in FIG. 5 having similar operation. The use of an electric motor 65 for either the jaw displacer 60 or the eyeball mover 96 obviates the need for a lever 62 but requires a power source 66.

Figure 6:
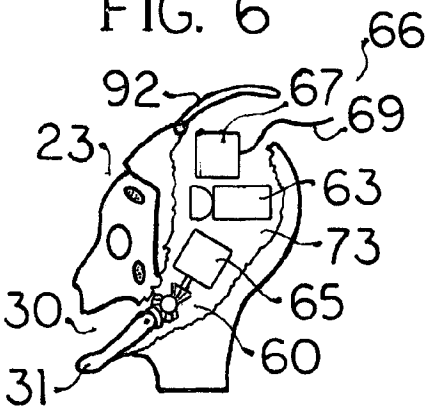
FIG. 6 is a partially cut away side view of the head depicted in FIG. 4 illustrating a skull cavity, an audio device therein, an electric motor for displacement of the jaw and power supply for the same.

Electric motors 65 come in two basic varieties: direct or alternating current (DC or AC); although microprocessor controlled DC motors that closely simulate the operation of AC motors are also well known particularly for use in cooling personal computers. These 'hybrid' type electric motors 65 have a rotating stator field controlled by the microprocessor. It is largely immaterial as to what type of electric motor 65 is utilized with regard to the present invention except for the type of power source 66 necessary to supply the same. An AC electric motor 65 requires an electrical cord 69 as seen in FIG. 6 and a DC electric motor 65 requires a battery 67, also represented in FIG. 6 and further seen therein to occupy a skull cavity 73. Unless the battery 67 is rechargeable in which case an AC/DC transformer, not shown, can also be included in the simulated skull 23 and the electrical cord 69 used to recharge the battery 67; it is suggested that the skull cavity 73 be accessible through a hinged pate 92 as further depicted in FIG. 6 in order to periodically renew the battery 67.

A jaw displacer 60 is intended primarily for simulation of speech and hence it is further recommended that an audio device 63 capable of reproducing a simulation of human speech, most preferably capable of playing a recording of the same, be provided preferably in a skull cavity 73 as seen, again, in FIG. 6. The potential of the capability of simulated human speech is considered to be extremely significant with regard to achieving the primary purpose of the principles relating to the present invention: it adds another dimension of verisimilitude; in addition to visual and palpable verisimilitude of the human form audio verisimilitude is added. It is preferred that the audio device 63 be of a conventional type that allows an owner of a doll 10, in preferred accordance with the principles relating to the present invention including this optional feature, to make their own recordings of human speech for playback by the doll 10. In this regard the capability of customization, as opposed to manufactured variety, is considered most important.

And this capability is considered to underscore the more basic variety of human verisimilitude enabled by adherence to the principles relating to the present invention in a preferred manner: certain aspects primarily including but not restricted to the exchange of face 13 displayed by a doll 10 in accordance with said principles enable a variety of human verisimilitude without the prohibitive expense of having to purchase, or manufacture, multiple whole separate different dolls 10.

The foregoing is intended to provide one practiced in the art with what is the best known manner of making and using a full size fully articulated doll with selectively displayed alternative faces and is not to be interpreted in any manner as restrictive of the invention described herein nor of the rights and privileges secured by Letters Patent for which I claim:

The invention claimed is:

1. A figure toy amusement device comprising:

an articulated skeleton having a plurality of rigid members with movable joints between adjacent rigid members largely encased in relatively soft, resilient material presenting an exterior form possessing the size and appearance of a human female including: a head, a face mask removably attachable by means of fastening components to said head, a torso, and a pair of arms and legs each movably attached to said torso;

said movable joints between adjacent rigid members enabling a range of motion approximating that of a human's permitting movement: of each said arm and each said leg with respect to said torso, of an upper portion of said arm with respect to a lower portion of said arm, and an upper portion of said leg with respect to a lower portion of said leg;

said head possessing a simulated skull and also being movable with respect to said torso through an articulated neck and possessing: attachment means for a wig, a jaw movable with respect to said simulated skull, and a mouth lined with a smooth membrane and having a fluid receptacle located there behind;

said face mask possessing lips, chin, nose, cheeks, eye sockets, and eyebrows all molded in an integral piece of soft resilient flexible material separate from said head and providing a verisimilitude of a female human face for said head in attached disposition thereon;

said torso possessing a bosom possessing human verisimilitude in shape and feel and a vulva located between said two legs lined with a smooth membrane and having a fluid receptacle located there behind;

whereby a wig attached to said head with said attachment means for a wig, artificial eyeballs located in said eye sockets, and said face mask attached to said head provide a full sized fully articulate doll with selectively displayed alternate faces and visual, postural, and palpable verisimilitude with a female human figure.

2. The figure toy amusement device of claim 1 with said simulated skull made of epoxy.

3. The figure toy amusement device of claim 1 having hooked and looped fabric used as said attachment means for a wig.

4. The figure toy amusement device of claim 1 having some of said rigid members of said skeleton made of aluminum.

5. The figure toy amusement device of claim 1 having some of said rigid members of said skeleton made of polyvinylchloride tubing.

6. The figure toy amusement device of claim 1 having simulated flesh encased by simulated skin comprising said relatively soft, resilient material presenting an exterior form possessing the size and appearance of a human female.

7. The figure toy amusement device of claim 6 having said simulated flesh made of medium density polyurethane.

8. The figure toy amusement device of claim 6 having said simulated skin made of silicone rubber.

9. The figure toy amusement device of claim 1 having pivoted joints comprising said movable joints between adjacent rigid members.

10. The figure toy amusement device of claim 9 having hinged joints comprising some of said pivoted joints comprising said movable joints between adjacent rigid members.

11. The figure toy amusement device of claim 10 having adjustable resistance in movement of said hinged joints provided with variance of a threaded fastener operative upon overlapping adjacent opposed extensions of said hinged joints.

12. The figure toy amusement device of claim 9 having rotary joints comprising some of said pivoted joints comprising said movable joints between adjacent rigid members.

13. The figure toy amusement device of claim 12 having adjustable resistance in movement of said rotary joints provided with variance of a threaded fastener operative upon concentrically disposed opposed parts of said rotary joint.

14. The figure toy amusement device of claim 9 having both hinged joints and rotary joints combined in one combination joint comprising some of said pivoted joints between adjacent rigid members.

15. The figure toy amusement device of claim 14 having a combination joint movably connecting a hand to the distal end of each said arm.

16. The figure toy amusement device of claim 14 having a combination joint movably connecting each said leg to said torso.

17. The figure toy amusement device of claim 14 having a combination joint movably connecting each said arm to said torso.

18. The figure toy amusement device of claim 1 possessing an audio device capable of reproducing recorded human speech.

19. The figure toy amusement device of claim 18 having said audio device supplied with power from batteries.

20. The figure toy amusement device of claim 18 having said audio device supplied with power through an electrical cord.

21. The figure toy amusement device of claim 18 having said audio device located in a skull cavity of said simulated skull.

22. The figure toy amusement device of claim 21 having said skull cavity accessible through a hinged pate of said simulated skull.

23. The figure toy amusement device of claim 1 having a displacer for displacing said movable jaw.

24. The figure toy amusement device of claim 23 having a displacer that is operative solely with mechanical means displacing said movable jaw.

25. The figure toy amusement device of claim 24 having a lever extending from a nape of said simulated skull included among said mechanical means.

26. The figure toy amusement device of claim 23 having an electric motor driving said displacer.

27. The figure toy amusement device of claim 26 having an alternating current electric motor.

28. The figure toy amusement device of claim 26 having a direct current electric motor.

29. The figure toy amusement device of claim 26 having a hybrid, rotating field, electric motor.

30. The figure toy amusement device of claim 1 having removable attachment means enabling removable attachment of said head.

31. The figure toy amusement device of claim 30 with said face mask being molded with a negative mold portion with an open interior cavity obtained from a molded impression of an actual human face.

32. The figure toy amusement device of claim 30 having threading comprising said removable attachment means.

33. The figure toy amusement device of claim 30 having at least one helical groove mating an opposed lug comprising said removable attachment means.

34. The figure toy amusement device of claim 1 with said face mask and said head each having at least one of two opposed mating positive fastening components.

35. The figure toy amusement device of claim 34 with said two opposed mating positive fastening components comprised of hooked and looped fabric.

36. The figure toy amusement device of claim 34 with said two opposed mating positive fastening components comprised of a resilient ball and socket.

37. The figure toy amusement device of claim 1 having said head and said body substantially integral through said articulated neck possessing a substantially permanent articulated connection through one said movable joint.

38. A figure toy amusement device of claim 37 with said face mask being molded with a negative mold portion with an open interior cavity obtained from a molded impression of an actual human face.

39. The figure toy amusement device of claim 37 with said face mask molded in silicone rubber.

40. The figure toy amusement device of claim 37 with said face mask being further inclusive of a forehead.

41. The figure toy amusement device of claim 40 with said face mask being further inclusive of eyelashes.

42. The figure toy amusement device of claim 40 with said face mask being further inclusive of ears.

43. The figure toy amusement device of claim 37 with said face mask and said head each having at least one of two opposed mating positive fastening components.

44. The figure toy amusement device of claim 43 with said two opposed mating positive fastening components comprised of hooked and looped fabric.

45. The figure toy amusement device of claim 43 with said two opposed mating positive fastening components comprised of a resilient ball and socket.

46. The figure toy amusement device of claim 43 with a margin about the edge of said face mask lacking fastening components facilitating manual removal.

* * * * *